US010145195B2

(12) United States Patent
Craddock, Jr. et al.

(10) Patent No.: US 10,145,195 B2
(45) Date of Patent: Dec. 4, 2018

(54) WELL-COMPONENT SEVERING TOOL WITH A RADIALLY-NONUNIFORM EXPLOSIVE CARTRIDGE

(71) Applicant: Halliburton Energy Services, Inc., Houston, TX (US)

(72) Inventors: Gerald Graves Craddock, Jr., Mansfield, TX (US); Justine Marie Davidson, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 144 days.

(21) Appl. No.: 15/127,678

(22) PCT Filed: May 12, 2014

(86) PCT No.: PCT/US2014/037665

§ 371 (c)(1),
(2) Date: Sep. 20, 2016

(87) PCT Pub. No.: WO2015/174956

PCT Pub. Date: Nov. 19, 2015

(65) Prior Publication Data

US 2017/0145767 A1 May 25, 2017

(51) Int. Cl.

| | |
|---|---|
| ***E21B 29/02*** | (2006.01) |
| ***E21B 31/00*** | (2006.01) |
| ***F42B 3/12*** | (2006.01) |

(52) U.S. Cl.
CPC ..... *E21B 29/02* (2013.01); *E21B 31/00* (2013.01); *F42B 3/122* (2013.01)

(58) Field of Classification Search
CPC ..... E21B 29/02; E21B 29/005
See application file for complete search history.

(56) References Cited

U.S. PATENT DOCUMENTS

| | | | | |
|---|---|---|---|---|
| 2,831,429 | A * | 4/1958 | Moore | F42B 3/08 102/307 |
| 2,839,997 | A * | 6/1958 | Church | F42B 12/14 102/307 |
| 2,935,020 | A * | 5/1960 | Howard | E21B 29/02 102/307 |
| 3,031,964 | A * | 5/1962 | Chesnut | E21B 43/117 102/319 |
| 3,053,182 | A * | 9/1962 | Christopher | B26F 3/04 102/307 |

(Continued)

FOREIGN PATENT DOCUMENTS

| | | |
|---|---|---|
| EP | 211515 | 2/1987 |
| EP | 371161 | 6/1990 |

OTHER PUBLICATIONS

International Patent Application No. PCT/US2014/037665, International Search Report and Written Opinion dated Feb. 24, 2015, 15 pages.

*Primary Examiner* — Shane Bomar
(74) *Attorney, Agent, or Firm* — Kilpatrick Townsend & Stockton LLP

(57) ABSTRACT

An assembly for an explosive device for severing a well component is provided. The assembly can include an outer housing. The assembly can also include a radially-nonuniform explosive cartridge disposed within the outer housing, and the radially-nonuniform explosive cartridge can include at least four protrusions.

16 Claims, 7 Drawing Sheets

(56) References Cited

U.S. PATENT DOCUMENTS

| | | | | | |
|---|---|---|---|---|---|
| 3,253,653 | A * | 5/1966 | Layne, Sr. | E21B 23/04 | 102/313 |
| 3,666,030 | A * | 5/1972 | Bohn | E21B 41/0085 | 166/55.1 |
| 4,018,293 | A * | 4/1977 | Keller | E21B 43/263 | 102/307 |
| 4,185,551 | A * | 1/1980 | Drimmer | F42B 22/42 | 102/307 |
| 4,248,303 | A | 2/1981 | Charpentier et al. | | |
| 4,378,844 | A | 4/1983 | Parrish et al. | | |
| 4,794,990 | A * | 1/1989 | Riggs | E21B 41/02 | 102/306 |
| 5,467,824 | A | 11/1995 | DeMarsh et al. | | |
| 5,544,711 | A * | 8/1996 | Aitken | E21B 43/117 | 166/55 |
| 5,791,417 | A * | 8/1998 | Haugen | E21B 7/061 | 166/117.6 |
| 7,104,326 | B2 | 9/2006 | Grattan et al. | | |
| 7,530,397 | B2 | 5/2009 | Bell et al. | | |
| 2011/0094406 | A1 * | 4/2011 | Marya | E21B 43/117 | 102/305 |
| 2013/0284441 | A1 | 10/2013 | Brooks et al. | | |
| 2015/0345245 | A1 * | 12/2015 | Bell | E21B 43/117 | 102/310 |

* cited by examiner

WELL-COMPONENT SEVERING TOOL WITH A RADIALLY-NONUNIFORM EXPLOSIVE CARTRIDGE

TECHNICAL FIELD

The present disclosure relates generally to devices for use in well systems. More specifically, but not by way of limitation, this disclosure relates to a well-component severing tool with a radially-nonuniform explosive cartridge.

BACKGROUND

A well system (e.g., oil or gas wells for extracting fluids or gas from a subterranean formation) can include, among other components, interconnected pipes, valves, or tubes in a wellbore. While operating a well, an event may occur (for example, a wellbore wall may collapse) that can cause a component to become trapped in the wellbore. It can be desirable to salvage as much of the component as possible. One method of salvaging components stuck downhole is by severing, typically through the use of an explosive device, the component at a point above the location where the component is trapped. If successful, the free portion of the component can then be withdrawn from the wellbore. It can be challenging, however, to sever well components downhole adequately.

DETAILED DESCRIPTION

Certain aspects and features of the present disclosure are directed to a well-component severing tool (hereinafter a "severing tool") with a radially-nonuniform explosive cartridge (hereinafter a "RN explosive cartridge"). Unlike explosive cartridges that have radially uniform (e.g., circular) cross-sectional shapes, an explosive cartridge can be radially nonuniform if the cross-sectional shape is noncircular. The noncircular cross-sectional shape can include protrusions, depressions, angled surfaces, or other nonuniformities. For example, in some embodiments, the cross-sectional shape can include a starburst shape or a spoke shape. There can be any number of protrusions, depressions, angled surfaces, or other nonuniformities in the cross-sectional shape of the RN explosive cartridge. In some embodiments, the RN explosive cartridge can include an azimuthally asymmetric shape.

In some embodiments, the outer surface of the RN explosive cartridge can be confined, for example, by a copper housing. In some embodiments, confining the outer surface of the RN explosive cartridge can enhance the severing capabilities of the severing tool. Further, in some embodiments, the explosive material within the RN explosive cartridge can be coated, for example, with a clad metal, a powdered metal, or a spray-type coating. Coating the explosive material can enhance the severing capabilities of the severing tool.

In one example, the severing tool can be positioned downhole for severing a well component (e.g., positioned directly above a location downhole at which the well component is trapped). Upon detonating the severing tool, pressure waves can be emitted from the ends of protrusions (e.g., the points of the starburst) in the cross-sectional shape of the RN explosive cartridge outward towards the well component. Further, additional pressure waves can be emitted from the sides of the protrusions (e.g., the sides of the points of the starburst) in the cross-sectional shape of the RN explosive cartridge. In some embodiments, the additional pressure waves can collide, generating combined pressure waves. The combined pressure waves can be directed outward towards the well component. The pressure waves and combined pressure waves can create fractures in the well component in multiple locations. The fractures can expand in size and unite, which can sever the well component. The free end of the severed well component can then be extracted from the wellbore.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1A:
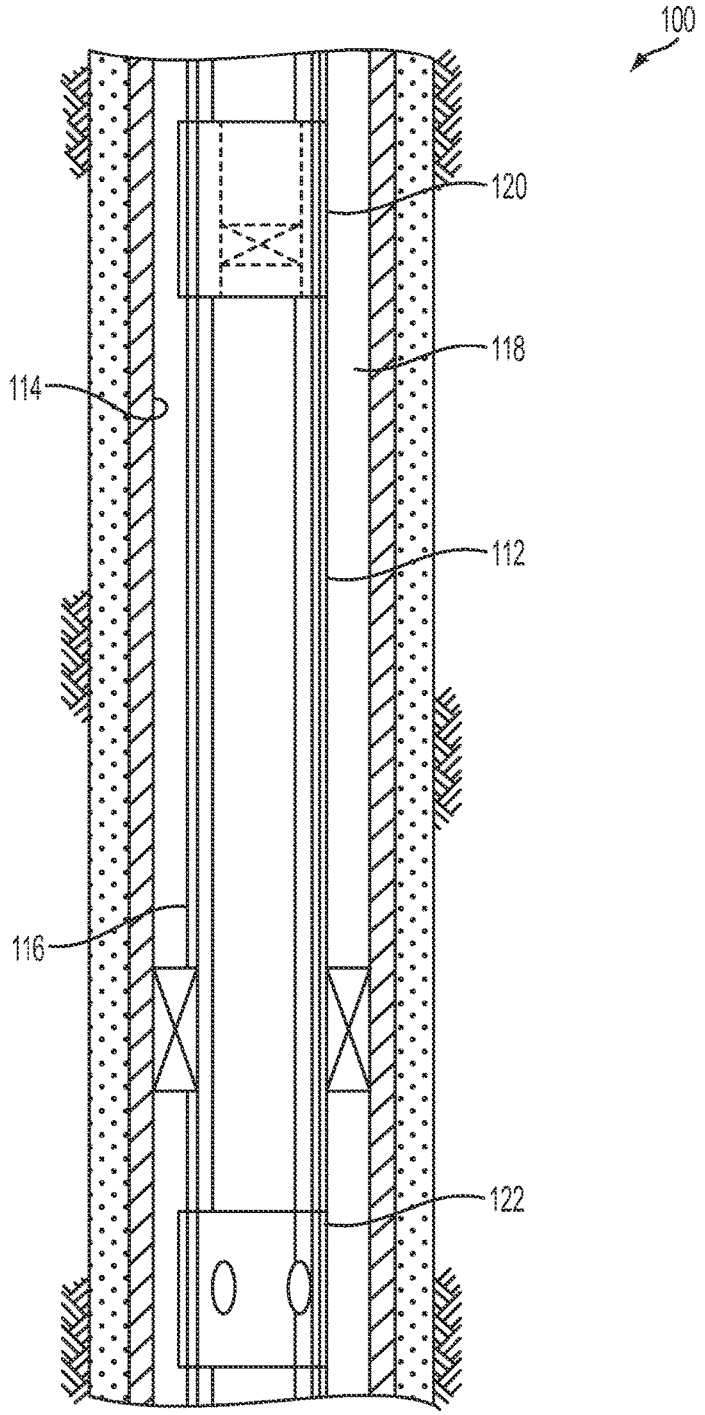
FIG. 1A is a cross-sectional side view of one embodiment of a system for a well-component severing tool with a radially-nonuniform explosive cartridge according to one aspect of the present disclosure.

FIG. 1A is a cross-sectional side view of one embodiment of a system 100 for a well-component severing tool with a radially-nonuniform explosive cartridge according to one aspect of the present disclosure. In this example, the system 100 is a well system (e.g., an oil or gas well for extracting fluids from a subterranean formation). The well system includes a wellbore 114, which includes a well component 112 (e.g., a tubular string). In some embodiments, the wellbore 114 can be cased and cemented, as shown in FIG. 1. In other embodiments, the wellbore 114 can be uncased or the casing may not be cemented. An annulus 118 can be formed between the well component 112 and the wellbore 114.

The well system can further include well tools 120, 122 (e.g., a safety valve and a production valve, respectively) interconnected to the well component 112. In some embodiments, the well component 112 can include one or more tubular strings within it. One or more lines 116 can extend through the annulus 118 and along the length of the well component 112, for example, to communicate power or data to a well component.

While operating the well system, an event may occur that can cause the well component 112 to become stuck in the wellbore 114. For example, the wall of the wellbore 114 may collapse, as shown in FIG. 1B.

Figure 1B:
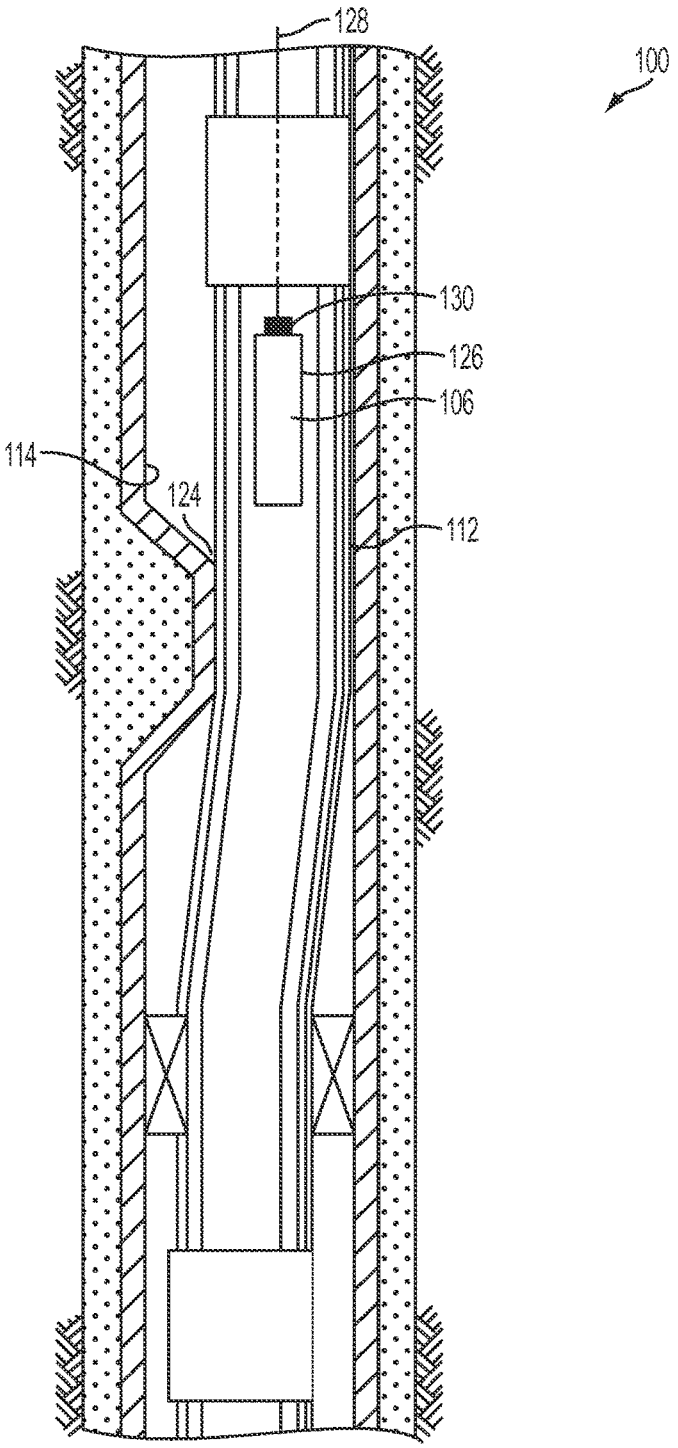
FIG. 1B is a cross-sectional side view of the embodiment shown in FIG. 1A in which a wellbore wall has collapsed on a well component.

FIG. 1B is a cross-sectional side view of the embodiment shown in FIG. 1A in which a wall of the wellbore 114 has collapsed on a well component 112. The wellbore 114 is collapsed at a collapse location 124. The collapsed portion of the wellbore 114 is pressing the well component 112 against the opposite side of the wellbore 114 which, in some instances, can cause the well component 112 to wedge tightly in the wellbore 114.

To salvage as much of the well component 112 as possible, a severing tool 126 can be lowered into the wellbore 114. The severing tool 126 can include a RN explosive cartridge positioned longitudinally in an inner area of the severing tool 126. In some embodiments, the RN explosive cartridge can be positioned in the approximately longitudinal center 106 of the inner area of the severing tool 126. In some embodiments, the severing tool 126 can be lowered into the wellbore on a wireline 128. The severing tool 126 can include a mechanical connector 130 for connecting the wireline 128 to the severing tool 126. The mechanical connector 130 can include, for example, a metal loop or a carabiner. In some embodiments, the severing tool 126 can be positioned in the wellbore 114 immediately above the collapse location 124. Upon detonating explosives in the severing tool 126, the trapped well component 112 can be split (as shown in FIG. 1C) allowing the free portion to be withdrawn from the wellbore 114.

Figure 1C:
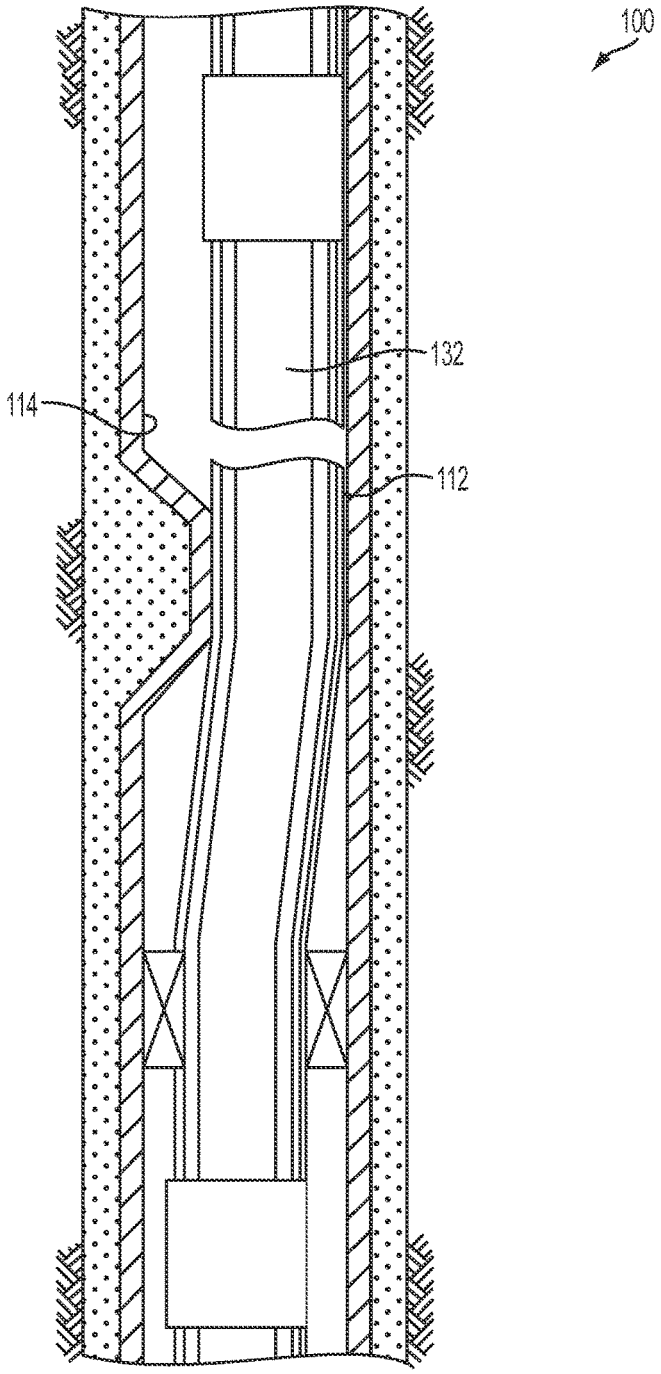
FIG. 1C is a cross-sectional side view of the embodiment shown in FIG. 1B in which the well component has been severed.

FIG. 1C is a cross-sectional side view of the embodiment shown in FIG. 1B in which the well component 112 has been severed. In this example, the severing tool has detonated, splitting the well component 112 into two pieces. The free piece 132 of the well component 112 can be extracted from the wellbore 114.

Figure 2:
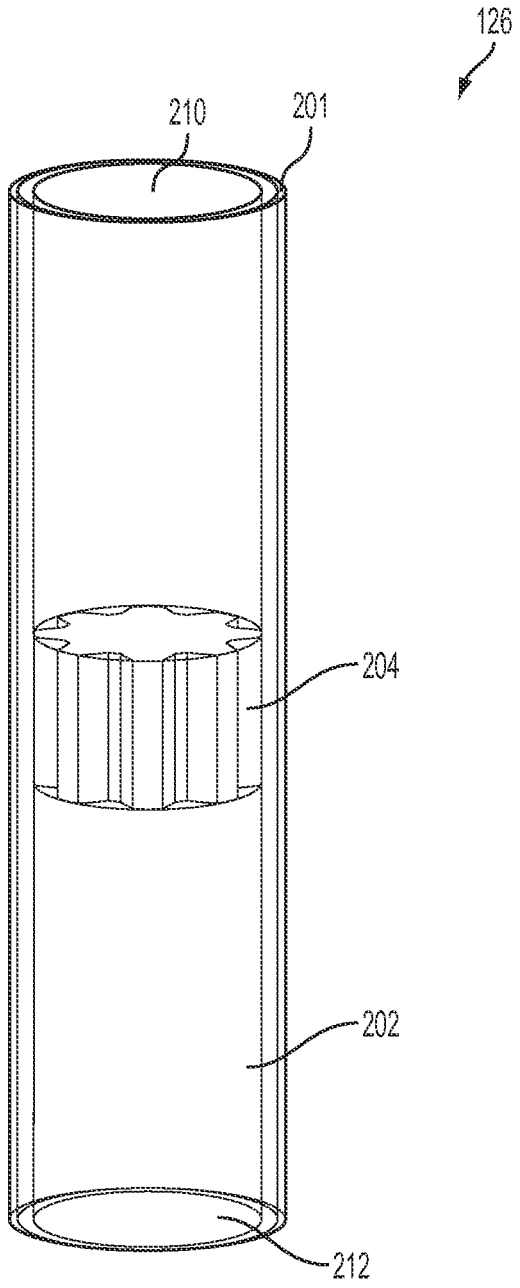
FIG. 2 is a cross-sectional side view of one embodiment of an assembly for a well-component severing tool with a radially-nonuniform explosive cartridge according to one aspect of the present disclosure.

FIG. 2 is a cross-sectional side view of one embodiment of an assembly for a well-component severing tool 126 with a radially-nonuniform explosive cartridge according to one aspect of the present disclosure. In this example, the severing tool 126 has an outer housing 201. Explosives 202 can be positioned throughout the length of the outer housing 201. The explosives 202 can include a RN explosive cartridge 204. The RN explosive cartridge 204 can be positioned longitudinally within an inner area defined by the outer housing 201. In some embodiments, the RN explosive cartridge 204 can be positioned in the approximately longitudinal center of the inner area defined by the outer housing 201.

The RN explosive cartridge 204 includes an outer surface. In this example, radial nonuniformities create a corrugated shape in the outer surface of the RN explosive cartridge 204. In some embodiments, the outer surface of the RN explosive cartridge 204 can include multiple protrusions. For example, the outer surface of the RN explosive cartridge 204 can include at least four protrusions.

In some embodiments, the outer surface of the RN explosive cartridge 204 can be confined, for example, by a copper housing. The copper housing can be conformed to the shape of the RN explosive cartridge 204. In some embodiments, the copper housing can enhance the severing capabilities of the severing tool 126. Further, the explosive material within the explosives 202 or the RN explosive cartridge 204 can be coated, for example, with a clad metal, a powdered metal, or a spray-type coating. Coating the explosive material can enhance the severing capabilities of the severing tool 126.

The explosives 202 and the RN explosive cartridge 204 can include explosive material. In some embodiments, the explosive material can include Research Department Explosive (RDX), High Melting Explosive (HMX), or Hexanitrostilbene (HNS). In some embodiments, the protrusions in the RN explosive cartridge 204 can include more explosive material than in other areas of the RN explosive cartridge 204.

In some embodiments, the explosives 202 can be detonated at a top end 210 and a bottom end 212 substantially simultaneously. Upon detonation, a pressure wave can be generated by an explosion from the top end 210 of the explosives 202. Likewise, a pressure wave can be generated by an explosion from the bottom end 212 of the explosives 202. The pressure wave from the explosion at the top end 210 of the explosives 202 can collide with the pressure wave from the explosion at the bottom end 212 of the explosives 202. The pressure waves can collide in the approximately longitudinal center of the severing tool 126. The collision of the pressure waves can generate a combined pressure wave that can be more powerful than the independent pressure waves generated from the explosion from the top end 210 and the explosion from the bottom end 212 of the explosives 202. The combined pressure wave can expand radially outward from the middle of the severing tool 126, which can cause a well component to be severed.

Figure 3:
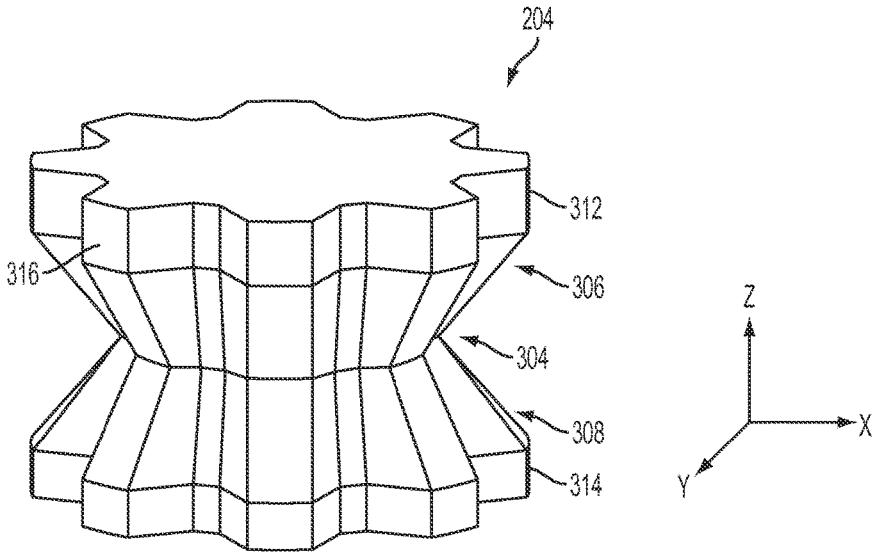
FIG. 3 is a perspective view of another embodiment of an assembly for a well-component severing tool with a radially-nonuniform explosive cartridge according to one aspect of the present disclosure.

FIG. 3 is a perspective view of another embodiment of an assembly for a well-component severing tool with a radially-nonuniform explosive cartridge 204 according to one aspect of the present disclosure. In this example, the outer surface of the RN explosive cartridge 204 is nonuniform along the z-axis. In some embodiments, nonuniformities along the z-axis can enhance the severing capability of the severing tool.

In this example, the outer surface of the RN explosive cartridge 204 includes top protrusions 312 and bottom protrusions 314. The top protrusions 312 and the bottom protrusions 314 include front surfaces 316 that can be substantially planar in shape. In some embodiments (e.g., the embodiment shown in FIG. 4), the top protrusions 312 and bottom protrusions 314 can include front surfaces 316 with nonplanar shapes, for example, cones, points, angled surfaces, or other shapes.

In some embodiments, the cross-sectional diameter of the RN explosive cartridge 204 can decrease in size from the top protrusions 312 towards the longitudinal middle 304 of the RN explosive cartridge 204. In some embodiments, the decrease in the size of the cross-sectional diameter of the RN explosive cartridge 204 can be linear. The decreasing size of the cross-sectional diameter of the RN explosive cartridge 204 can form an angled surface 306 between the top protrusions 312 and the longitudinal middle 304 of the RN explosive cartridge 204. Likewise, the cross-sectional diameter of the RN explosive cartridge 204 can decrease in size (e.g., linearly) from the bottom protrusions 314 towards the longitudinal middle 304 of the RN explosive cartridge 204. The decreasing size of the cross-sectional diameter of the RN explosive cartridge 204 can form an angled surface 308 between the bottom protrusions 314 and the longitudinal middle 304 of the RN explosive cartridge 204.

In some embodiments, the cross-sectional diameter of the RN explosive cartridge 204 can change in size multiple times along the longitude of the RN explosive cartridge 204, which can produce multiple protrusions and multiple angled surfaces 306, 308 along the z-axis.

Figure 4A:
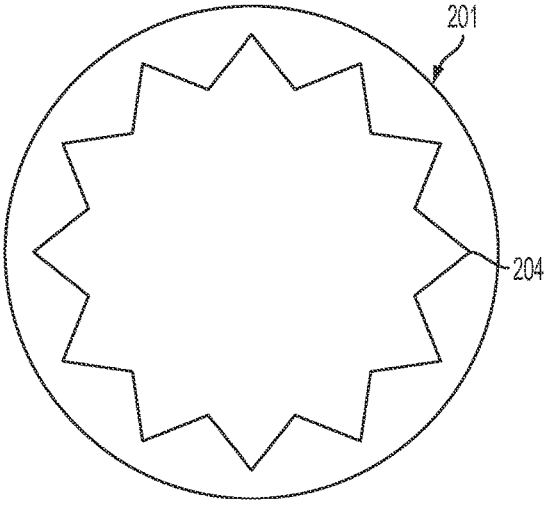
FIG. 4A is a cross-sectional end view of another embodiment of an assembly for a well-component severing tool with a radially-nonuniform explosive cartridge according to one aspect of the present disclosure.

FIG. 4A is a cross-sectional end view of another embodiment of an assembly for a well-component severing tool with a radially-nonuniform explosive cartridge 204 according to one aspect of the present disclosure. In this example, the severing tool includes an outer housing 201. A RN explosive cartridge 204 is positioned within an inner area defined by the outer housing 201.

In this example, the RN explosive cartridge 204 includes a starburst shape. The starburst shape can include any number of points. In some embodiments, the RN explosive cartridge 204 can include slopes, cones, rounded edges, or other configurations (e.g., a spoke configuration). Further, in some embodiments, the RN explosive cartridge 204 can be nonuniform in three dimensions (e.g., can include protrusions along the z-axis), as depicted in FIG. 3.

Figure 4B:
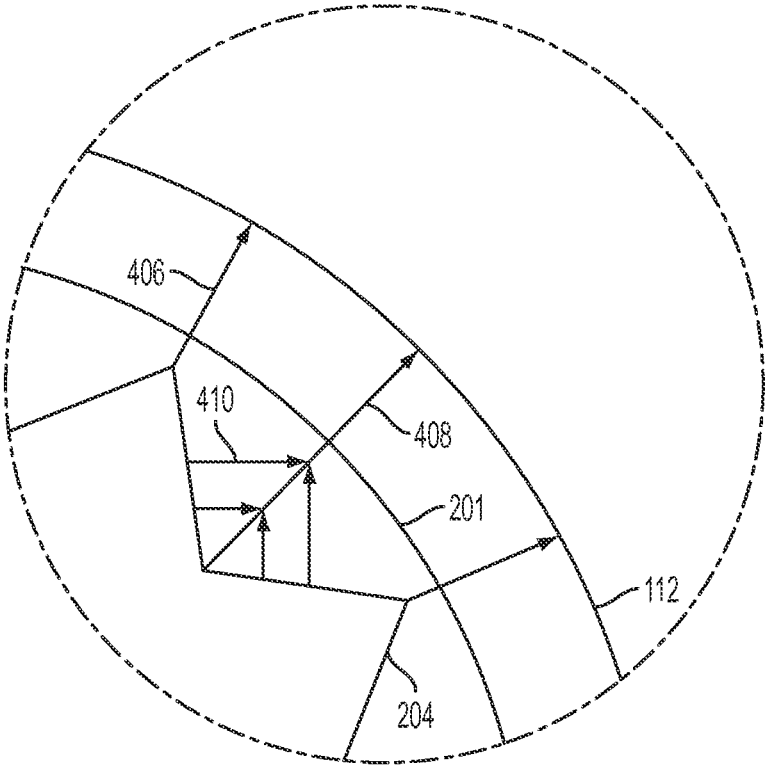
FIG. 4B is a close-up, cross-sectional end view of the embodiment shown in FIG. 4A of an assembly for a well-component severing tool with a radially-nonuniform explosive cartridge according to one aspect of the present disclosure.

FIG. 4B is a close-up, cross-sectional end view of the embodiment shown in FIG. 4A of an assembly for a well-component severing tool with a radially-nonuniform explosive cartridge 204 according to one aspect of the present disclosure. In this example, a RN explosive cartridge 204 is positioned within an outer housing 201 of a severing tool. The severing tool can be positioned within a well component 112. The well component 112 can be positioned downhole, for example, in a wellbore. In this example, the RN explosive cartridge 204 includes a starburst cross-sectional shape.

In some embodiments, upon detonating the severing tool, pressure waves 406 can be emitted from the ends of the protrusions (e.g., the points of the starburst) in the RN explosive cartridge 204 outward towards the well component 112. Further, in some embodiments, pressure waves 410 can be emitted from the sides of the protrusions (e.g., the sides of the points of the starburst) in the RN explosive cartridge 204. In some embodiments, the pressure waves 410 emitted from the sides of the RN explosive cartridge 204 protrusions can collide, generating a combined pressure wave 408. The combined pressure wave 408 can be directed outward towards the well component 112. In some embodiments, the pressure waves 406, 408 can fracture the well component 112 in multiple locations. The separate fractures can expand in size and unite, which can sever the well component 112.

Further, in embodiments with nonuniformities along the z-axis (e.g., as shown in FIG. 3), pressure waves can be emitted from the tops of the protrusions and bottoms of the protrusions along the z-axis. In some embodiments, the pressure waves emitted from the tops of the protrusions and bottoms of the protrusions along the z-axis can collide, generating combined pressure waves. The combined pressure waves can be directed outward towards the well component 112. In some embodiments, the combined pressure waves from the nonuniformities along the z-axis can enhance the severing capability of the severing tool.

Figure 5:
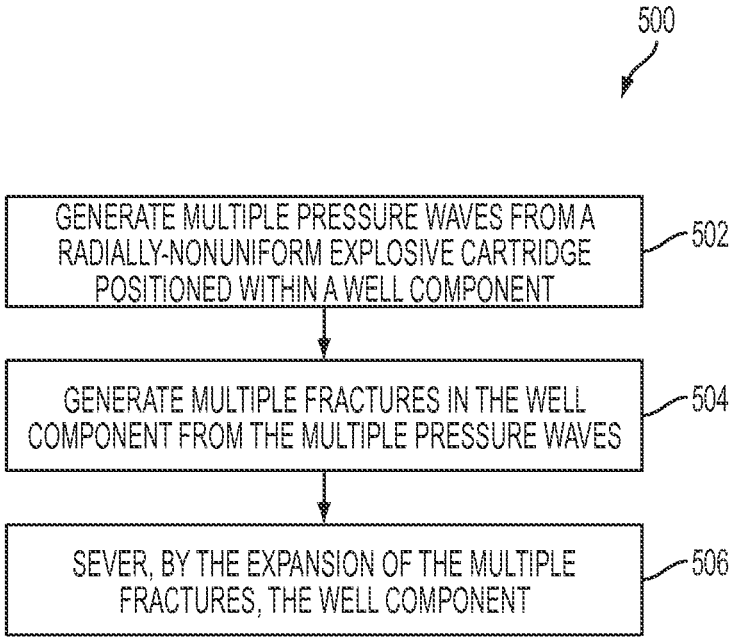
FIG. 5 is an example of a flow chart of a process for using a well-component severing tool with a radially-nonuniform explosive cartridge according to one embodiment.

FIG. 5 is an example of a flow chart of a process 500 for using a well-component severing tool with a radially-nonuniform explosive cartridge according to one embodiment.

In block 502, multiple pressure waves are generated from a radially-nonuniform explosive cartridge. The radially non-uniform explosive cartridge can be positioned within a well component. Further, in some embodiments, the radially non-uniform explosive cartridge can include at least four protrusions.

The multiple pressure waves can be generated by detonating the RN explosive cartridge. In some embodiments, the RN explosive cartridge can be detonated by a fuse assembly. The fuse assembly can conduct a signal, such as an electric charge, to an initiator near the RN explosive cartridge. In some embodiments, multiple fuse assemblies, initiators, and/or a timer can be used to detonate the RN explosive cartridge. In some embodiments, multiple explosive charges within the severing tool can be detonated sequentially or substantially simultaneously.

In some embodiments, the multiple pressure waves can be emitted from the RN explosive cartridge radially outward towards the well component. In some embodiments, some of the pressure waves can collide, generating combined pressure waves. The combined pressure waves can be emitted radially outward from the RN explosive cartridge towards the well component.

In block 504, the multiple fractures are generated in the well component from the multiple pressure waves. The fractures can vary in size and shape.

In block 706, the multiple fractures expand to sever the well component. In some embodiments, the multiple fractures can naturally expand in size and unite to sever the well component. In some embodiments, the multiple fractures can expand in size and unite due to the stress on the well component as a result of gravity, the environmental pressure downhole (e.g., as a result of hydrostatic pressure), and/or other forces.

In some aspects, a system for a well-component severing tool with a radially-nonuniform explosive cartridge is provided according to one or more of the following examples.

Example #1

An assembly for an explosive device for severing a well component can include an outer housing. The assembly can also include a radially-nonuniform explosive cartridge disposed within the outer housing, the radially-nonuniform explosive cartridge comprising at least four protrusions.

Example #2

The assembly of Example #1 may feature the radially-nonuniform explosive cartridge including a spoke shape or starburst shape cross-sectionally.

Example #3

The assembly of any of Examples #1-2 may feature the radially-nonuniform explosive cartridge being nonuniform along a z-axis.

Example #4

The assembly of any of Examples #1-3 may feature the radially-nonuniform explosive cartridge including an angled surface along the z-axis.

Example #5

The assembly of any of Examples #1-4 may feature the radially-nonuniform explosive cartridge positioned in a longitudinal middle of the outer housing.

Example #6

The assembly of any of Examples #1-5 may feature the radially-nonuniform explosive cartridge including: Research Department Explosive, High Melting Explosive, or Hexanitrostilbene.

Example #7

The assembly of any of Examples #1-6 may feature the exterior of the radially-nonuniform explosive cartridge having a corrugated shape.

Example #8

The assembly of any of Examples #1-7 may feature the radially-nonuniform explosive cartridge including an explosive that is coated with a clad metal or a powdered metal.

Example #9

The assembly of any of Examples #1-8 may feature a mechanical connector coupled to a wireline for positioning the explosive device in the well component.

Example #10

An assembly can include a radially-nonuniform explosive cartridge housed within an explosive device for severing a well component. The radially-nonuniform explosive cartridge can include at least four protrusions.

Example #11

The assembly of Example #10 may feature the radially-nonuniform explosive cartridge including a spoke shape or starburst shape cross-sectionally.

Example #12

The assembly of any of Examples #10-11 may feature the radially-nonuniform explosive cartridge being nonuniform along a z-axis.

Example #13

The assembly of any of Examples #10-12 may feature the radially-nonuniform explosive cartridge positioned in a longitudinal middle of the explosive device.

Example #14

The assembly of any of Examples #10-13 may feature the radially-nonuniform explosive cartridge including: Research Department Explosive, High Melting Explosive, or Hexanitrostilbene.

Example #15

The assembly of any of Examples #10-14 may feature an exterior of the radially-nonuniform explosive cartridge having a corrugated shape.

Example #16

The assembly of any of Examples #10-15 may feature the radially-nonuniform explosive cartridge including an explosive that is coated with a clad metal or a powdered metal.

Example #17

The assembly of any of Examples #10-16 may feature a mechanical connector coupled to a wireline for positioning the explosive device in the well component.

Example #18

A method can include generating multiple pressure waves from a radially-nonuniform explosive cartridge that includes at least four protrusions, the radially-nonuniform explosive cartridge positioned within a well component. The method can also include generating multiple fractures in the well component from the multiple pressure waves. Further, the method can include severing, by an expansion of the multiple fractures, the well component.

Example #19

The method of Example #18 may feature at least two of the multiple pressure waves being generated substantially simultaneously.

Example #20

The method of any of Examples #18-19 may feature generating, by a collision of the at least two of the multiple pressure waves, a combined pressure wave directed towards the well component.

The foregoing description of certain embodiments, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly for an explosive device for severing a well component, the assembly comprising:

an outer housing; and a radially-nonuniform explosive cartridge disposed within the outer housing, the radially-nonuniform explosive cartridge comprising a top end having a corrugated circumferential shape with four or more protrusions, a bottom end also having a corrugated circumferential shape with four or more protrusions, and a middle between the top end and the bottom end, wherein the radially-nonuniform explosive cartridge slopes inwardly from the top end and the bottom end toward the middle, wherein the radially-nonuniform explosive cartridge is positioned in a longitudinal middle of a longitudinal axis of the outer housing.

2. The assembly of claim 1, wherein the radially-nonuniform explosive cartridge comprises a spoke shape or starburst shape cross-sectionally.

3. The assembly of claim 1, wherein each of the protrusions at the top end and at the bottom end slopes inwardly toward the middle to form a respective angled surface.

4. The assembly of claim 1, wherein the radially-nonuniform explosive cartridge comprises: Research Department Explosive, High Melting Explosive, or Hexanitrostilbene.

5. The assembly of claim 1, wherein the exterior of the radially-nonuniform explosive cartridge has a corrugated shape.

6. The assembly of claim 1, wherein the radially-nonuniform explosive cartridge includes an explosive that is coated with a clad metal or a powdered metal.

7. The assembly of claim 1, further comprising a mechanical connector coupled to a wireline for positioning the explosive device in the well component.

8. An assembly comprising:

a radially-nonuniform explosive cartridge housed within an explosive device for severing a well component, wherein the radially-nonuniform explosive cartridge comprises a top end having a corrugated circumferential shape with four or more protrusions, a bottom end also having a corrugated circumferential shape with four or more protrusions, and a middle between the top end and the bottom end, wherein the radially-nonuniform explosive cartridge slopes inwardly from the top end and the bottom end to the middle, and wherein the radially-nonuniform explosive cartridge is positioned in a longitudinal middle of a longitudinal axis of the explosive device.

9. The assembly of claim 8, wherein the radially-nonuniform explosive cartridge comprises a spoke shape or starburst shape cross-sectionally.

10. The assembly of claim 8, wherein the radially-nonuniform explosive cartridge comprises: Research Department Explosive, High Melting Explosive, or Hexanitrostilbene.

11. The assembly of claim 8, wherein an exterior of the radially-nonuniform explosive cartridge has a corrugated shape.

12. The assembly of claim 8, wherein the radially-nonuniform explosive cartridge includes an explosive that is coated with a clad metal or a powdered metal.

13. The assembly of claim 8, further comprising a mechanical connector coupled to a wireline for positioning the explosive device in the well component.

14. A method, comprising:

generating a plurality of pressure waves from a radially-nonuniform explosive cartridge positioned within a well component, wherein the radially-nonuniform explosive cartridge is positioned in a longitudinal middle of a longitudinal axis of an outer housing and comprises a top end having a corrugated circumferential shape with four or more protrusions, a bottom end also having a corrugated circumferential shape with four or more protrusions, and a middle between the top end and the bottom end, and wherein the radially-nonuniform explosive cartridge slopes inwardly from the top end and the bottom end toward the middle;

generating a plurality of fractures in the well component from the plurality of pressure waves; and severing, by an expansion of the plurality of fractures, the well component.

15. The method of claim 14, wherein at least two of the plurality of pressure waves are generated substantially simultaneously.

16. The method of claim 15, further comprising:

generating, by a collision of the at least two of the plurality of pressure waves, a combined pressure wave directed towards the well component.

* * * * *